United States Patent [19]

Davies et al.

[11] 4,407,722

[45] Oct. 4, 1983

[54] FABRIC WASHING PROCESS AND DETERGENT COMPOSITION FOR USE THEREIN

[75] Inventors: James F. Davies, Wirral; John B. Tune, Higher Bebington, both of England

[73] Assignee: Lever Brothers Company, New York, N.Y.

[21] Appl. No.: 387,308

[22] Filed: Jun. 11, 1982

[30] Foreign Application Priority Data

Jun. 18, 1981 [GB] United Kingdom ..... 8118802

[51] Int. Cl.[3] ..... C11D 17/00; C11D 7/06

[52] U.S. Cl. ..... 252/91; 252/156; 252/174; 252/174.13; 252/174.14; 252/DIG. 11

[58] Field of Search ..... 252/91, 156, 174, 174.13, 252/174.14, DIG. 11

[56] References Cited

U.S. PATENT DOCUMENTS 4,040,988 8/1977 Benson .

FOREIGN PATENT DOCUMENTS 991942 6/1976 Canada .

1437950 6/1976 United Kingdom .

*Primary Examiner*—Mary F. Downey

*Attorney, Agent, or Firm*—Milton L. Honig; James J. Farrell

[57] ABSTRACT

Fabric, particularly soiled fabrics containing calcium carbonate crystal growth poisons, may be washed in hard water to which has been added a detergent active material and an alkali metal carbonate if a secondary detergency builder is added after a defined critical state of the system is reached. The secondary builder may be a precipitating, sequestering or ion exchange builder, and is added in such an amount which would be insufficient, in the absence of the carbonate, to reduce the free calcium ion concentration to less than $10^{-5}$ molar. The delayed addition can be achieved by separate dosing, coating the secondary builder, dosing the composition in the form of a two-compartment sachet or forming the secondary builder material in situ. The composition may include a material, such as calcite, to promote the occurrance of the critical state.

1 Claim, 1 Drawing Figure

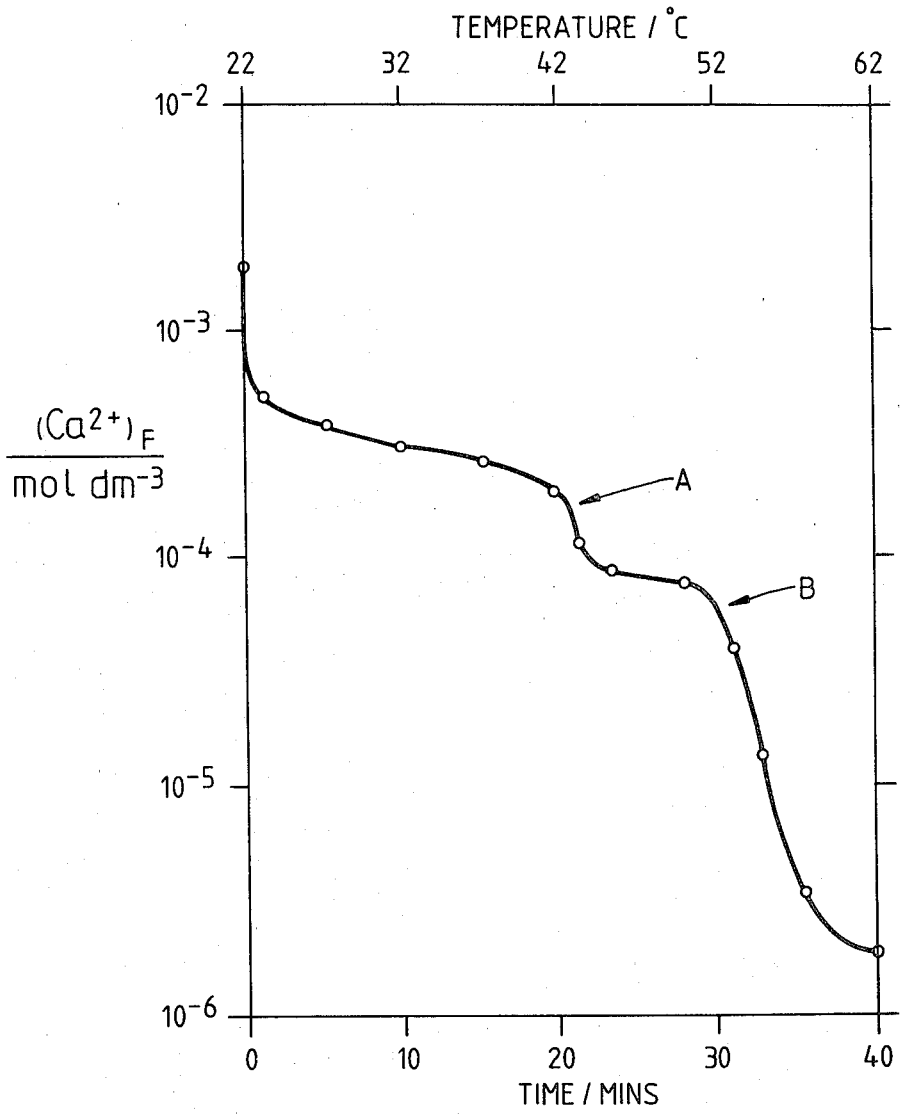
TEMPERATURE / °C
22
32
42
52
62
$10^{-2}$
$10^{-3}$
$10^{-4}$
$10^{-5}$
$10^{-6}$
$\frac{(Ca^{2+})_F}{mol\ dm^{-3}}$
A
B
0
10
20
30
40
TIME / MINS

FABRIC WASHING PROCESS AND DETERGENT COMPOSITION FOR USE THEREIN

TECHNICAL FIELD

This invention relates to a method of washing fabrics and to a composition useful in carrying out such a process.

BACKGROUND ART

Detergent manufacturers have long recognised the need to control water hardness to ensure adequate cleaning by detergents. The detergency builders used in the past have been of two main types, namely sequestering builders and precipitating builders. A typical precipitating builder is an alkali metal carbonate, especially sodium carbonate. While from a cost point of view sodium carbonate would be an attractive builder, it has at least two significant disadvantages. Firstly, sodium carbonate alone is not usually capable of reducing the calcium ion concentration in calcium hard water to sufficiently low levels to achieve good detergency under practical washing conditions. This is because crystal growth is inhibited by materials, in particular condensed phosphates, which can arise from the soiled laundry load, or be present as contamination in the detergent composition. Secondly, the use of carbonate ions to precipitate the calcium hardness from the water can result in the deposition of calcium carbonate on the washed fabrics. It is known that the calcium carbonate precipitate is produced in such a crystal type and such a particle size that deposition on the fabrics is favoured. The presence of certain crystal growth poisons in the wash liquor can encourage this deposition. Typical such poisons are inorganic phosphates carried into the wash liquor from the soiled fabrics in cases where the fabrics have previously been washed in a composition containing tripolyphosphate.

It has previously been suggested that the calcium ion concentration can be reduced by including in the compositions substantial quantities of a high surface area insoluble material to act as a seed crystal and crystal growth poison adsorbent. Thus GB No. 1 437 950 (Case No C.720/736) relates to detergent compositions containing both an alkali metal carbonate and about 15% high surface area calcium carbonate, particularly calcite. However, while the use of calcite may reduce the calcium ion concentration in the wash liquor the compositions are more difficult to handle and may lead to increased inorganic deposition on the fabrics. Also, the use of large quantities of such calcite in a composition may detract from the cost savings achieved from using sodium carbonate.

The calcium ion concentration in a wash liquor can be reduced to sufficiently low levels by the use of, for example, a sequestering builder material such as sodium tripolyphosphate, and considerable commercial success has been achieved with phosphate-built formulations. However, it has now become apparent that, under some conditions, the discharge of significant quantities of phosphates into waste waters may produce environmental problems. There is therefore an increasing desire in some countries to reduce the level of phosphorus in detergent compositions.

It is known to provide detergent compositions in which at least one component is treated in such a manner that it becomes effective in the wash liquor only after a specific delay. Thus, for example, U.S. Pat. No. 4,040,988 (Procter & Gamble Company) discloses a detergent composition containing two specific granules. The first contains sodium carbonate and calcite. The second, which is treated in such a manner as to delay its dissolution in the wash liquor, contains a sequestering builder such as sodium tripolyphosphate, sodium silicate and a detergent active material. It is said that such a composition gives satisfactory depletion of calcium hardness from the water while utilising a lower total content of phosphorus than hitherto.

By delaying the dissolution of sequestering builder, its effect as a calcium carbonate crystal growth posion is said to be reduced. We have discovered, however, that such compositions may not reduce the free calcium ion concentration to sufficiently low levels if the wash liquor already contains a crystal growth poison.

DISCLOSURE OF THE INVENTION

We have discovered that, in a wash liquor containing sodium carbonate as a builder, the precipitation of calcium carbonate by reaction between the calcium hardness and the sodium carbonate takes place via a series of steps which are transient in the absence of crystal growth poisons, but can be isolated in their presence, and that, if a secondary builder is added after the system has reached a particular state, referred to herein as the "critical state", the free calcium ion concentration in the wash liquor is reduced to about $10^{-5}$ molar or lower. If, on the other hand, a secondary builder is added prior to the system reaching the critical state, this reduction in free calcium ion concentration is not achieved at all or is not achieved within a reasonable time.

The time period required for a system to reach the critical state after the addition of sodium carbonate to the hard water is thought to depend on a number of factors among which are the initial water hardness, the quantity of sodium carbonate added, the quantity of crystal growth poisons present either from the wash load, from the added composition or in the liquor itself, the pH of the liquor, the temperature or temperature profile of the liquor and the nature of other materials which may be present.

According to the invention there is provided a method of washing fabrics in water containing calcium hardness, comprising contacting the fabrics with a wash liquor to which has been added at least a synthetic detergent active material and an alkali metal carbonate as a primary detergency builder and bringing into effective contact with the wash liquor a secondary detergency builder, the secondary detergency builder being brought into effective contact with the wash liquor at or after the wash liquor has reached the critical state as hereinbefore defined, and being added in such an amount as to reduce the free calcium ion concentration in the wash liquor to about $10^{-5}$ or less within at most 60 minutes preferably within about 30 minutes from the addition of the alkali metal carbonate to the hard water, the amount of the secondary builder being such that would not, in the absence of said carbonate, reduce the free calcium ion concentration to less than about $10^{-5}$ molar.

The term "effective contact" between the secondary builder material and the wash liquor as used herein is intended to mean the reaction between the secondary builder material and the calcium hardness of the water.

BEST MODE OF CARRYING OUT THE INVENTION

The time at which the critical state is reached for a given composition and wash conditions may be determined by a series of experiments as follows. A substantially similar load of fabrics is washed in an identical wash liquor under identical conditions and the secondary builder is added at various times between 1 minute and 30 minutes from the addition of the alkali metal carbonate to the liquor. After 60 minutes the free calcium ion concentration is measured. The critical state has been achieved when this final free calcium ion concentration is not more than about $10^{-5}$ molar. Alternatively, or where a similar load of soiled fabrics is not available, this series of experiments may be carried out with a clean load of similar fabrics while an appropriate level of crystal growth poison is included in the hard water.

It is also possible to determine whether the system has reached the critical state by determining one or more of a number of alternative or additional criteria. Thus, when the system reaches its critical state the form of the calcium carbonate precipitate changes from an X-ray amorphous form to an X-ray crystalline form. Still further, the calcium carbonate precipitate is colloidally suspended. When the critical state is reached the precipitate settles rapidly.

When the secondary builder is added, some of the already precipitated calcium carbonate may pass back into the solution, for the calcium ions to be precipitated in some other form. Thus, where the secondary builder is a phosphate material, some of the already precipitated calcium carbonate may be transformed into a calcium phosphate form. It is found that, after the system has reached the critical state, at least about 40% of the initial calcium hardness remains as the solid calcium carbonate form when the secondary builder is added.

When the method includes the step of heating the wash liquor from a temperature below say 30° C. to a temperature above say 40° C. at a rate between about 0.2 and 5.0, such as between about 0.5 and 2.0 Centigrade degrees per minute, the system will generally have reached its critical state by the time the temperature reaches about 40° C.

When the conditions are such that the precipitation of calcium carbonate occurs in such a manner that calcium carbonate hexahydrate is formed, it is found that this form of calcium carbonate has disappeared when the system reaches its critical state. The transient formation of the hexahydrate may occur in conditions of high water hardness, high poison levels, low temperatures and in the absence of seed crystals.

It is essential to the present invention that the water in which the fabrics was washed contains calcium hardness. Preferably the concentration of calcium ions in the water before the addition of the alkali metal conbonate is at least 10°FH, preferably at least 15°FH (ie $10^{-3}$, $1.5\times10^{-3}$ molar respectively), these figures including any calcium ions derived from the fabrics.

The wash liquor according to the invention necessarily includes a synthetic detergent active material otherwise referred to herein simply as a detergent compound. This may be added with the primary builder material, with the secondary builder material or at some other time. The detergent compounds may be selected from anionic, nonionic, zwitterionic and amphoteric synthetic detergent active materials. Many suitable detergent compounds are commercially available and are fully described in the literature, for example in "Surface Active Agents and Detergents", Volumes I and II, by Schwartz, Perry and Berch.

The preferred detergent compounds which can be used are synthetic anionic and nonionic compounds. The former are usually water-soluble alkali metal salts of organic sulphates and sulphonates having alkyl radicals containing from about 8 to about 22 carbon atoms, the term alkyl being used to include the alkyl portion of higher acyl radicals. Examples of suitable synthetic anionic detergent compounds are sodium and potassium alkyl sulphates, especially those obtained by sulphating higher ($C_8$–$C_{18}$) alcohols produced for example from tallow or coconut oil; sodium and potassium alkyl ($C_9$–$C_{20}$) benzene sulphonates, particularly sodium linear secondary alkyl ($C_{10}$–$C_{15}$) benzene sulphonates; sodium alkyl glyceryl ether sulphates, especially those ethers of the higher alcohols derived from tallow or coconut oil and synthetic alcohols derived from petroleum; sodium coconut oil fatty monoglyceride sulphates and sulphonates; sodium and potassium salts of sulphuric acid esters of higher ($C_8$–$C_{18}$) fatty alcohol-alkylene oxide, particularly ethylene oxide, reaction products; the reaction products of fatty acids such as coconut fatty acids esterified with isethionic acid and neutralised with sodium hydroxide; sodium and potassium salts of fatty acid amides of methyl taurine; alkane monosulphonates such as those derived by reacting alpha-olefins ($C_8$–$C_{20}$) with sodium bisulphite and and those derived from reacting paraffins with $SO_2$ and $Cl_2$ and then hydrolysing with a base to produce a random sulphonate; and olefin sulphonates, which term is used to describe the material made by reacting olefins, particularly $C_{10}$–$C_{20}$ alpha-olefins, with $SO_3$ and then neutralising and hydrolysing the reaction product. The preferred anionic detergent compounds are sodium ($C_{11}$–$C_{15}$) alkyl benzene sulphonates and sodium ($C_{16}$–$C_{18}$) alkyl sulphates.

Suitable nonionic detergent compounds which may be used include in particular the reaction products of compounds having a hydrophobic group and a reactive hydrogen atom, for example aliphatic alcohols, acids, amides or alkyl phenols with alkylene oxides, especially ethylene oxide either alone or with propylene oxide. Specific nonionic detergent compounds are alkyl ($C_6$–$C_{22}$) phenols-ethylene oxide condensates, generally 5 to 25 EO, ie 5 to 25 units of ethylene oxide per molecule, the condensation products of aliphatic ($C_8$–$C_{18}$) primary or secondary linear or branched alcohols with ethylene oxide, generally 5 to 40 EO, and products made by condensation of ethylene oxide with the reaction products of propylene oxide and ethylenediamine. Other so-called nonionic detergent compounds include long chain tertiary amine oxides, long chain tertiary phosphine oxides and dialkyl sulphoxides.

Mixtures of detergent compounds, for example mixed anionic or mixed anionic and nonionic compounds may be used in the detergent compositions, particularly in the latter case to provide controlled low sudsing properties. This is beneficial for compositions intended for use in suds-intolerant automatic washing machines. We have also found that the use of some nonionic detergent compounds in the compositions decreases the tendency of insoluble phosphate salts to deposit on the washed fabrics, especially when used in admixture with some soaps as described below.

Amounts of amphoteric or zwitterionic detergent compounds can also be used in the compositions of the invention but this is not normally desired due to their relatively high cost. If any amphoteric or zwitterionic detergent compounds are used it is generally in small amounts in compositions based on the much more commonly used synthetic anionic and/or nonionic detergent compounds.

For example, mixtures of amine oxides and ethoxylated nonionic detergent compounds can be used.

Soaps may also be present in the detergent compositions of the invention. The soaps are particularly useful at low levels in binary and ternary mixtures, together with nonionic or mixed synthetic anionic and nonionic detergent compounds, which have low sudsing properties. The soaps which are used are the water-soluble salts of $C_{10}$–$C_{20}$ fatty acids in particular with inorganic cations such as sodium and potassium. It is particularly preferred that the soaps should be based mainly on the longer chain fatty acids within this range, that is with at least half of the soaps having a carbon chain length of 16 or over. This is not conveniently accomplished by using soaps from natural sources such as tallow, palm oil or rapeseed oil, which can be hardened if desired, with lesser amounts of other shorter chain soaps, prepared from nut oils such as coconut oil or palm kernel oil. The amount of such soaps can be up to about 20% by weight, with lower amounts of about 0.5% to about 5% being generally sufficient for lather control. Amounts of soap between about 2% and about 20%, especially between about 5% and about 15%, can advantageously be used to give a beneficial effect on detergency and reduced levels of incrustation.

An alkalimetal carbonate is used as a primary detergency builder material in the present invention. The alkalimetal carbonate which is added to the wash liquor of the invention is preferably selected from carbonates, and sesquicarbonates of sodium and potassium. Particularly preferred is sodium carbonate. The term "primary detergency builder material" is to be interpreted that other builder materials (other than the carbonate and the delayed secondary builder material) may be present, but at levels less than the amount of carbonate, preferably at levels less than half the amount of carbonate. However, ideally the compositions contain as builders only carbonate and the secondary builder material to be described below. The use of sodium bicarbonate alone as the primary detergency builder material is not possible as the corresponding calcium salt is not sufficiently insoluble.

The secondary builder material which is added to the wash liquor may be selected from precipitating builder materials, sequestering builder materials and ion-exchange builder materials and materials capable of forming such builder material in situ. The secondary builder material is necessarily a material other than an alkali metal carbonate.

When the secondary builder material is a water-soluble precipitating builder material, it may be selected from the soaps, alkyl malonates, alkenyl succinates, sodium fatty acid sulphonates, orthophosphates of sodium, potassium and ammonium, or in their water-soluble partially or fully acidified forms. Particularly where the hard water contains magnesium ions, the silicates of sodium and potassium may be included, but not as the sole secondary builder material.

The secondary builder may also be constituted by a sequestering builder material, particularly those selected from water-soluble pyro-phosphates, polyphosphates, phosphonates, polyhydroxy-sulfonates, polyacetates, carboxylates, polycarboxylates, and succinates.

Specific examples of inorganic phosphate builders include sodium and potassium tripolyphosphates, pyrophosphates, and polymerphosphates such as hexametaphosphate or glassy phosphates. The poly-phosphonates specifically include, for example, the sodium and potassium salts of ethylene diphosphonic acid, the sodium and potassium salts of ethane 1-hydroxy-1,1-diphosphonic acid and the sodium and potassium salts of ethane-1,1,2-triphosphonic acid.

Water-soluble, organic sequestering builders are also useful herein. For example, the alkali metal, ammonium and substituted ammonium polyacetates, carboxylates, polycarboxylates, polyacetylcarboxylates and polyhydroxysulfonates are useful sequestering builders in the present compositions. Specific examples of the polyacetate and polycarboxylate builder salts include sodium, potassium, lithium, ammonium and substituted ammonium salts of ethylene diamine tetraacetic acid, nitrilotriacetic acid, oxydisuccinic acid, mellitic acid, benzene polycarboxylic acids, citric acid and the polyacetalcarboxylates disclosed in U.S. Pat. Nos. 4,144,126 and 4,146,495. The acid forms of these materials may also be used.

Highly preferred non-phosphorus sequestering builder materials herein include sodium citrate, sodium oxydisuccinate, sodium mellitate, sodium nitrilotriacetate, and sodium ethylene diamine tetraaacetate and mixtures thereof.

Other highly preferred sequestering builders are the polycarboxylate builders. Examples of such materials include the water-soluble salts of the homo- and copolymers of aliphatic carboxylic acids such as maleic acid, itaconic acid, mesaconic acid, fumaric acid, aconitic acid, citraconic acid, methylenemalonic acid, 1,1,2,2-ethane tetracarboxylic acid, dihydroxy tartaric acid, and keto-malonic acid.

Additional preferred sequestering builders herein include the water-soluble salts, especially the sodium and potassium salts of carboxy methyloxymalonate, carboxymethyloxysuccinate, cis-cyclohexanehexacarboxylate, cis-cyclopentanetetracarboxylate, and phloroglucinol trisulfonate.

Most preferably the sequestering builder of the present invention is a water-soluble salt, particularly sodium and potassium tripolyphosphates, pyrophosphates, and nitrilotriacetates.

The secondary builder material may also be constituted by an ion-exchange material. Suitable ion-exchange materials include the amorphous or crystalline aluminosilicates such as disclosed in GB No. 1 473 201 (Henkel).

As stated previously it is essential that the secondary builder is not brought into effective contact until the system has reached the critical state.

In the preferred embodiments of the present invention one may take steps to promote occurrence of the critical state. Such promotion may be achieved for example by (a) heating the wash liquor to a temperature in excess of 40° C. and optionally subsequently cooling or (b) adding to the wash liquor up to about 0.5 g/l, preferably up to about 0.4 g/l of a seed crystal such as fine particulate calcium carbonate (eg calcite); (c) increasing the initial hardness of the water by adding to the wash liquor a source of calcium ions such as calcium chloride;

or (d) adding to the wash liquor a calcium carbonate growth poison suppressing agent such as a source of aluminium ions (eg aluminium sulphate). Alternative calcium carbonate growth poison suppressing agents include the soluble salts of iron, cobalt, manganese and copper.

Where the promotion of the critical state is achieved by the addition of a seed crystal, this material is preferably calcite having a surface area of from 2 to 20 $m^2/g$. A suitable material is Calofort U, available from Sturge Chemicals having a surface area of about 16 $m^2/g$. Calcite having a larger surface area (such as for example 80 $m^2/g$) may also be used, and in this case less of the material would be necessary. However, for ease of powder processing and for cost reasons the lower surface area material is preferred. A level of up to about 10% by weight of calcite in the composition is suitable.

In preferred embodiments of the invention, particularly where the composition contains a material to promote the critical stage, the secondary builder material is added to or released into the wash liquor between about 1 and about 10 minutes after the addition of the primary builder, more preferably from between about 4 and about 8 minutes thereafter.

The present invention also relates to a composition for washing fabrics in water containing calcium hardness, comprising at least (i) from about 2.5% to about 30% of at least one synthetic detergent active material;

(ii) at least about 10% an alkali metal carbonate as a primary detergency builder; and (iii) a secondary detergency builder, characterised by means for delaying the reaction between said secondary builder and the calcium hardness of the water until the critical state is reached. Such delay may be achieved by employing the secondary builder in a variety of physically or chemically modified forms including the use of precursors which when the composition is added to water are capable of releasing the secondary builder by hydrolysis or other chemical reaction. As it is necessary for the secondary builder to enter the wash liquor after the alkalimetal carbonate, it follows that the alkalimetal carbonate and the secondary builder material should not be intimately mixed together.

Preferred compositions according to the invention contain, based on the weight of the total composition:

from about 5% to about 30%, such as between about 8% and about 25% of at least one synthetic detergent active material;

from about 10% to about 50%, preferably from about 15%, more preferably from about 20% to about 40% of alkali metal carbonate; and from about 2% to about 20%, preferably from about 5% to about 15% of at least one secondary builder.

The balance of the composition, if any, will be water and other conventional additives as referred to below.

As stated above, the compositions of the invention may include soaps. When present, the soap should not constitute more than about 20% by weight. The soap may in some instances as explained further below, act as a secondary builder. In this case the total quantity of the soap and any other secondary builder which may be present should preferably not exceed about 20% of the composition.

Apart from the essential detergent active compounds and detergency builders, the detergent compositions used in the process of the invention can contain any of the conventional additives in the amounts in which such materials are normally employed in fabric washing detergent compositions. Examples of these additives include lather boosters such as alkanolamides, particularly the monoethanolamides derived from palm kernel fatty acids and coconut fatty acids, lather depressants such as alkyl phosphate, waxes and silicones, antiredeposition agents such as sodium carboxymethylcellulose and cellulose ethers, oxygen-releasing bleaching agents such as sodium perborate and sodium percarbonate, per-acid bleach precursors, chlorine-releasing bleaching agents such as trichloroisocyanuric acid and alkali metal salts of dichloroisocyanuric acid, fabric softening agents, inorganic salts, such as sodium sulphate, and magnesium silicate, and usually present in very minor amounts, fluorescent agents, perfumes, enzymes such as proteases and amylases, germicides and colourants.

It is particularly beneficial to include in the detergent compositions an amount of sodium perborate, preferably between about 10% and 40%, for example about 15% to about 30% by weight.

It is desirable to include one or more antideposition agents in the detergent compositions of the invention, to further decrease the tendency to form inorganic deposits on washed fabrics. The most effective antideposition agents are anionic polyelectrolytes, especially polymeric aliphatic carboxylates. The amount of any such antideposition agent can be from about 0.01% to about 5% by weight, preferably from about 0.2% to about 2% by weight of the compositions.

Specific preferred antideposition agents are the alkali metal or ammonium, preferably the sodium, salts or homo- or co-polymers of acrylic acid or substituted acrylic acids, such as sodium polyacrylate, the sodium salt of copolymethacrylamide/acrylic acid and sodium polyalpha-hydroxyacrylate, salts of copolymers of maleic anhydride with ethylene, acrylic acids, vinylmethylether allyl acetate or styrene, especially 1:1 copolymers, and optionally with partial esterification of the carboxyl groups. Such copolymers preferably have relatively low molecular weights, eg in the range of about 1,000 to 50,000. Other antideposition agents include the sodium salts of polyitaconic acid and polyaspartic acid, phosphate esters of ethoxylated aliphatic alcohols, polyethylene glycol phosphate esters, and certain phosphonates such as sodium ethane-1-hydroxy-1,1-diphosphonate, sodium ethylenediamine tetramethylene phosphonate, and sodium 2-phosphonobutane tricarboxylate. Mixtures of organic phosphonic acids or substituted acids or their salts with protective colloids such as gelatin may also be used. The most preferred antideposition agent is sodium polyacrylate having a MW of about 10,000 to 50,000, for example about 20,000 to 30,000. Where the antideposition agent is itself a calcium carbonate crystal growth poison, or in any case it may be desirable to delay contact between this material and the wash liquor until after the critical state is reached, for example by adding the antideposition agent with the secondary builder.

It is generally also desirable to include in the compositions an amount of an alkali metal silicate, particularly sodium ortho-, meta- or preferably neutral or alkaline silicate. The presence of such alkali metal silicates at levels of at least about 1%, and preferably from about 5% to about 15%, by weight of the composition, is advantageous in decreasing the corrosion of metal parts in washing machines, besides giving processing benefits and generally improved powder properties. The more highly alkaline ortho- and metal-silicates would normally only be used at lower amounts within this range, in admixture with the neutral or alkaline silicates.

The compositions of the invention are required to be alkaline, but not too strongly alkaline as this could result in fabric damage and also be hazardous for domestic usage. In practice the compositions should normally give a pH of from 9.5 to 11 in use in aqueous wash solution. The pH is measured at the lowest normal usage concentration of 0.1% w/v of the product in water of 12° (Ca), (French permanent hardness, calcium only) at 50° C. so that a satisfactory degree of alkalinity can be assured in use at all normal product concentrations.

The pH of the detergent compositions in use is controlled by the amount of alkali metal carbonate and any other alkaline salts such as alkali metal silicate, orthophosphate and sodium perborate present. The presence of such other alkaline salts, especially the alkali metal silicates, is particularly beneficial, because the alkalinity of the alkali metal carbonate diminishes in hard water due to precipitation of the calcium salt. The other ingredients in the alkaline detergent compositions of the invention should of course be chosen for alkaline stability, especially the pH sensitive materials such as enzymes.

The washing process of the invention can be accomplished manually, if desired, but is normally accomplished in a domestic or commercial laundry washing machine. The latter permits the use of higher wash temperatures and alkalinity, and more effective agitation, all of which contribute generally to better detergency. However, any wash temperature between ambient and boiling may be employed with any normal degree of alkalinity (pH 8–12). The type of washing machine used, if any, is not significant.

If the secondary builder is treated to delay its dissolution, for inclusion in a single composition with the primary builder this may be accomplished in the production of the secondary builder or subsequently. Thus the secondary builder may be employed in a variety of physically or chemically modified forms.

A suitable test for determining whether the secondary builder is in such a form to provide sufficient delay in practice is as follows. If the secondary builder material is a water-soluble builder material, the whole detergent composition containing the secondary builder material is added to water at 25° C. at a concentration equivalent to 1.59 g/l alkalimetal carbonate. At 1 minute the proportion of the secondary builder material which has dissolved in the water is determined. If less than half of the secondary builder material is found to have dissolved at this time, the secondary builder material is in a suitable form. In the case where the secondary builder material is a calcium carbonate crystal growth poison, less than 1 part in 100 of the secondary builder material should have dissolved at one minute.

However, where the secondary builder material is a water-insoluble builder material, the whole detergent composition is added at a concentration equivalent to 1.59 g/l alkalimetal carbonate to water at 25° C. containing sufficient calcium chloride to give a calcium hardness of 20° H. At 1 minute the free calcium ion concentration is measured by a conventional technique, for example by the use of a calcium electrode. If at 1 minute the free calcium ion concentration is not below $10^{-5}$ molar then the secondary builder is in a suitable form.

Specifically, the secondary builder may be made with a large particle size to delay its entry into the wash liquor.

An alternative means for delaying the reaction between the secondary builder and the calcium hardness of the water is to include in the composition one or more materials which will form the secondary builder material in situ. Thus the composition may include a material which will be neutralised by the alkaline medium of the wash liquor. Such materials include, for example, the water-soluble acid or diacid derivatives of suitable secondary builder materials. Alternatively, the composition may include a material which will be hydrolysed by the wash liquor. Such materials include, for example, the anhydride or ester derivatives of suitable secondary builder materials.

The delayed solubility of the second builder may be achieved by forming the detergent composition in the form of two containers, the first container containing optionally at least a part of the synthetic detergent active compound and essentially the alkali metal carbonate and the second container containing the secondary builder and optionally a further part of the synthetic detergent active compound. In use, the contents of the first container are released into water to form a wash liquor and subsequently the contents of the second container are released into the wash liquor.

Thus, the delayed solubility of the secondary builder may also be achieved by dosing the composition in a two-compartment sachet, the sachet being so constituted that when added to water the contents of the first compartment, namely the alkali metal carbonate and optionally at least some of the synthetic detergent active compound are released before the contents of the second compartment, namely the secondary builder and the remainder, if any, of the synthetic detergent active compound.

A suitable sachet construction of this type may be made from a first outer sheet of polyethylene film, a second outer sheet of acrylic bonded polyester/viscose non-woven fabric and an inner sheet of thermally bonded polypropylene non-woven fabric, these three sheets being heat-sealed together at the edges to define a sachet with two compartments. Before sealing the final edge, the first compartment between the two layers of non-woven fabric may be filled with the carbonate and at least some of the synthetic detergent active compound. The second compartment may be filled with the secondary builder and optionally a further part of the synthetic detergent active compound.

In use the contents of the second compartment are released after those of the first compartment because they must pass through the first compartment before entering the wash liquor.

The contact between the secondary builder and the wash liquor may also be delayed by coating or encapsulating the secondary builder with a water-dispersible water-insoluble material or with a water-soluble material. Examples of such coating materials include fatty acids, such as $C_{16}$–$C_{20}$ saturated fatty acids, alkanolamides of fatty acids, glycerol esters of fatty acids, long chain hydrocarbon aliphatic alcohols, paraffin waxes, mineral oil, proteins such as gelatin, sugar, nonionic surface active agents, polyvinylalcohol and sodium carboxymethylcellulose as described in U.S. Pat. No. 3,847,830 (Williams) and GB No. 1,242,247 (Unilever).

Coating to secondary builder ratios between about 0.5:1 and 2:1 by weight may be suitable.

The secondary builder may alternatively be coated with a temperature sensitive material which will dissolve or disperse at elevated temperatures. Two or more of these treatments may also be combined, so as to give close control over the solubility of the secondary builder under the recommended washing conditions.

A suitable method for coating the secondary builder with wax is to add the secondary builder in the form of a coarse powder (with a particle size of, for example, 200 to 300 microns) to molten wax and then cool to solidify the wax. Alternative methods of coating include spray cooling, pan granulation, extrusion or spray coating in a fluidised bed.

Where the secondary builder is a soap, the necessary delay can be achieved by selecting a soap or mixture of soaps with a particular Krafft point suitable for a washing method which includes a gradual heat up of the wash liquor, thereby ensuring that the soap does not dissolve until the system has had sufficient time to reach the critical state. A soap with a Krafft point in excess of about 40° C. is particularly suitable. The Krafft point of the soap is determined inter alia by the length of the carbon chain in the fatty acid from which the soap is derived. A particularly suitable soap is a 80/20 mixture of a first soap derived from a predominantly $C_{16}/C_{18}$ fatty acid with a second soap derived from a predominantly $C_{12}/C_{18}$ fatty acid.

Where the secondary builder or any other component of the composition is itself a crystal growth poison for carbonate (for example sodium tripolyphosphate),it should be treated in such a way that no more than a minimal amount of it is allowed to come into contact with the wash liquor before the critical state is reached. In the case of a secondary builder which is not a crystal growth poison (for example sodium nitrilotriacetate), it is allowable for a portion of the secondary builder to come into contact with the wash liquor before the critical state is reached, provided that there is sufficient secondary builder to come into contact with the liquor after the critical state has been reached to reduce the free calcium ion concentration to about $10^{-5}$ molar or less.

The detergent compositions used in the process of the invention may be either solid or liquid compositions. Either physical form can be used if the carbonate and secondary builder are included in different compositions for separate addition to the wash liquor. But if the carbonate and secondary builder are included in a single composition, with the latter being treated to delay its solubility, the composition will normally be in solid form, eg as a powdered or granulated product.

The optimum level of the various components of the compositions according to the invention will depend upon a number of factors including water hardness, poison level, wash temperture, liquor to cloth ratio and dosage level. For example, for low dosage levels (eg 1.5–5 g/l) a suitable composition may comprise:

from about 11% to about 25% synthetic detergent active;

from about 32% to about 40% alkalimetal carbonate;

from about 7% to about 10% calcite; and from about 10% to about 15% secondary builder material;

the balance being made up with water, filler materials and other conventional detergent composition additives as desired. In areas of relatively low water hardness, the carbonate and secondary builder levels may be decreased to 20–32% and 5–10% respectively.

For high dosage levels (eg 5–10 g/l) a suitable composition may comprise:

from about 8% to about 11% synthetic detergent active;

from about 20% to about 32% alkalimetal carbonate;

from about 5% to about 7% calcite; and from about 5% to about 10% secondary builder material;

the balance being as set out before. For areas of relatively high water hardness, the carbonate and secondary builder levels may be increased to 32–40% and 10–15% respectively.

The invention will now be further illustrated with reference to the following Examples.

EXAMPLE 1

The following experiment was carried out in a Terg-O-tometer apparatus. To 1 liter of London water (24°H hardness) was added 0.56 g of a nonionic detergent active (Tergitol 15-S-7), 1.6 g of the sodium carbonate (calculated on an anhydrous basis) and 0.03 g sodium tripolyphosphate. The latter material was added to represent the crystal growth poison which, under typical domestic conditions, could be expected to be produced by a soiled load. 3 pieces of a mixed soiled load each measuring 4"×6" were washed in this wash liquor. The wash time was 30 minutes and the temperature was increased from room temperature to 60° C. over the first 10 minutes of the wash and thereafter maintained at 60° C. for the remainder of the wash. After 5 minutes however 0.23 g sodium tripolyphosphate was added as a secondary builder the critical state having been reached. After washing the fabrics were rinsed by hand in demineralised water. The detergency efficiency was determined from the washed fabrics using conventional techniques and was found to be 63.2%.

The experiment was repeated, by way of comparison, with the modification that all the sodium tripolyphosphate was added at the beginning of the wash. In this case the measured detergency efficiency was 54.9%.

EXAMPLE 2

The following experiment was carried out in a Terg-o-tometer apparatus. To 1 liter of demineralised water to which sufficient calcium chloride was added to represent a hardness of 20°FH, there was added 0.055 g of an anionic detergent active (DOBS-055), and 0.01 g sodium tripolyphosphate as a crystal growth poison. After mixing for 2 minutes, 1.59 g sodium carbonate (calculated on an anhydrous basis) was added. This wash liquor was then heated to about 50° C., to allow the system to reach the critical state, and subsequently cooled to 25° C. Twelve pieces of soiled fabric, each 4"×44", were then washed in this liquor for 20 minutes at a temperature of 25° C. 0.6 g sodium tripolyphosphate was added to the wash liquor at the same time as the fabrics. The washed fabrics were rinsed by hand in demineralised water. The detergency efficiency was determined from the washed fabrics using conventional techniques and was found to be 62.5%.

The experiment was repeated, by way of comparison, with the modification that the heating and cooling step were omitted, the 0.6 g sodium tripolyphosphate being added immediately after the sodium carbonate. The detergency efficiency was found to be 51.1%.

EXAMPLE 3

Coated particles of nitrilotriacetic acid (NTAA) were prepared by melting 1 part by weight of hardened tallow fatty acid and stirring into the melt 1 part by weight of particulate NTAA. The liquid mixture was then spray cooled to give particles of coated NTAA. The following experiment was then carried out in a Terg-o-tometer apparatus. The particles had a particle size range of 250–600 microns.

To each of three pots containing 1 liter of demineralised water to which sufficient calcium chloride had been added to represent a hardness of 20°FH, there was added various components including sodium tripolyphosphate to simulate wash liquor poisoning in accordance with the following Table I.

TABLE I

| Ingredients added (g/l) | Example No. 3A | 3B | 3C |
|---|---|---|---|
| Sodium tripolyphosphate | 0.01 | 0.01 | 0.01 |
| Nonionic detergent active (Synperonic 7EO) | 0.5 | 0.5 | 0.5 |
| Sodium carbonate | 1.5 | 1.5 | 1.5 |
| Sodium alkaline silicate | 0.27 | 0.27 | 0.27 |
| Sodium sulphate | 0.84 | 0.84 | 0.84 |
| Sodium carboxymethyl cellulose | 0.05 | 0.05 | 0.05 |
| Coated NTA | 0.5 | 0.5 | — |
| Calcite (Calofort U 16 $m^2/g$) | — | 0.35 | 0.35 |
| NTA (not coated) | — | — | 0.25 |
| Hardened tallow fatty acid | — | — | 0.25 |

These wash liquors were then used to wash two different types of test cloth using a 15 minute wash cycle after the temperature had been increased from about 25° C. to about 40° C., at a a rate of about 3° C. per minute. After rinsing the washed fabrics, the detergency efficiency and level of inorganic deposition (ash) were assessed. In a separate series of experiments, the free calcium ion concentration of the wash liquor was assessed as a function of temperature. The results are set out in the following Tables II and III.

TABLE II

| Approximate free calcium ion concentrations ($\times 10^{-5}$ molar) | | | | |
|---|---|---|---|---|
| Time (Minutes) | Temperature (°C.) | Example No 3A | 3B | 3C |
| 0 | 25 | 200 | 200 | 200 |
| 5 | 30 | 10 | 2 | 8 |
| 10 | 35 | 9 | 0.9 | 8.5 |
| 15 | 40 | 8 | 0.7 | 7 |

These results demonstrate that only Example 3B, which contains both calcite to promote the critical state and coated NTA is capable of reducing the free calcium ion concentration to a level below $10^{-5}$ molar within 15 minutes. In Example 3A the fatty acid coating was insufficient to delay the contact between the NTA and the liquor until after the critical stage was reached.

TABLE III

| Detergency efficiency (%) | | | | |
|---|---|---|---|---|
| Test Cloth | Wash No | Example No 3A | 3B | 3C |
| I | 1 | 59 | 60 | 57 |
| | 5 | 57 | 63 | 59 |
| | 10 | 60 | 65 | 59 |
| II | 1 | 66 | 73 | 66 |
| | 5 | 68 | 81 | 70 |
| | 10 | 68 | 80 | 72 |

These results demonstrate that Example 3B, which contains both calcite to promote the critical state and coated NTA shows a consistant detergency benefit over the other formulations.

After 10 washes, Example 3B gave an acceptably low level of ash, of about 0.1%.

EXAMPLE 4

The following example demonstrates the effect of the time of adding the secondary builder on the final free calcium ion concentration.

To a liquor containing calcium chloride to represent a hardness of 20°FH, 10 ppm sodium tripolyphosphate as a crystal growth poison, 0.35 g/l calcite (Calofort U) and 1.59 g/l of sodium carbonate, at 25° C., there was added NTA (as the trisodium salt) at a level of 0.25 g/l after various periods of time, and the final free calcium ion concentration in each case was measured. Where the NTA was added in less than 3 minutes, the final free calcium ion concentration lay above $10^{-5}$ molar. When the NTA was added after 5 minutes, the final free calcium ion concentration was below $10^{-5}$ molar.

In the absence of the sodium carbonate, the NTA would be capable of reducing the final free calcium ion concentration only to $10^{-3}$ molar.

Similar results can be achieved when 0.56 g/l of nonionic detergent active material are included in the liquor.

EXAMPLE 5

The following example demonstrates the effect of the temperature on the final free calcium ion concentration.

To a liquor containing calcium chloride to represent a hardness of 20°FH, 10 ppm sodium tripolyphosphate, and 1.59 g/l sodium carbonate, 0.25 g/l NTA (as the trisodium salt) was added after 10 minutes. When a constant temperature of 25° C. was maintained, the free calcium ion concentration after 12 minutes was about $10^{-4}$ molar. When a temperature of 45° C. was maintained, the free calcium ion concentration after 12 minutes was about $2\times10^{-6}$ molar, thereby demonstrating that at 25° C. the critical state is not reached within 10 minutes, while at 45° C. the critical state is reached within 10 minutes.

Similar results can be achieved when 0.56 g/l of nonionic detergent active material are included in the liquor.

EXAMPLE 6

The following example demonstrates the effect of the temperature profile of the system on the final free calcium ion concentration.

A liquor similar to that used in Example 5 (20°FH/10 ppm STP/1.5 g/l $Na_2CO_3$) but additionally including 0.5 g/l commercial sodium stearate was heated from about 22° to about 62° C. in 40 minutes. The sodium stearate used in this example is in a commercial form comprising about 60% stearate and 30% palmitate, the balance being primarily the sodium salts of other fatty acids. The free calcium ion concentration was measured after certain time periods and the results are shown on the attached FIGURE. From the FIGURE, in which free calcium ion concentration is plotted against both temperature and time, it can be seen that in the first minute the free calcium ion concentration falls rapidly to a level between $10^{-3}$ and $10^{-4}$ molar where it remains for about 15 minutes. At this point, where the temperature is about 40° C., there is a sharp fall to a level of about $10^{-4}$ molar. This point, indicated in the FIGURE by the arrow 'A', is believed to be where the system reaches its critical state. A further sharp fall from about $10^{-4}$ molar to below $10^{-5}$ molar is observed at the point indicated in the FIGURE by the arrow 'B' after about 30 minutes and at a temperature of about 50° C. At this temperature the soap dissolves in the liquor and begins to act as the secondary builder.

Similar results can be achieved when 0.56 g/l of nonionic detergent active material are included in the liquor.

EXAMPLE 7

The following example demonstrates the effect of the concentration of the secondary builder on the final free calcium ion concentration.

To a liquor comprising 20°FH ($CaCl_2$), 10 ppm sodium tripolyphosphate and 0.53 g/l sodium carbonate at 25° C., a secondary builder was added at various concentrations and in each case the final free calcium ion concentration was measured. To ensure that the system had reached its critical state, the liquor was heated to 40° C. and then cooled to 25° C. before adding the secondary builder. In each case the final free calcium ion concentration was plotted against the concentration of the secondary builder to determine what level of secondary builder is required to reduce the free calcium ion concentration to $10^{-5}$ molar. A similar series of experiments was carried out where the secondary builder was added with the other components and the liquor was maintained at 25° C. throughout to ensure that the secondary builder entered the liquor before the critical state was reached. The results are given in the following table IV.

TABLE IV

| Concentration of secondary builder required to reduce free calcium ion concentration to $10^{-5}$ | | |
|---|---|---|
| | Concentration required ($\times 10^{-3}$ molar) | |
| Secondary Builder | Critical stage reached | Critical stage not reached |
| Sodium laurate | 2.6 | 4.4 |
| Sodium tripolyphosphate | 0.9 | 2.1 |
| NTA | 1.2 | 2.1 |

EXAMPLES 8 TO 11

Further exemplary detergent compositions which can be used in the method according to the invention are as set out in the following Table V.

TABLE V

| | Example | | | |
|---|---|---|---|---|
| Ingredient (% by weight) | 8 | 9 | 10 | 11 |
| Anionic detergent active[2] | 12 | 6 | 6 | 3 |
| Nonionic detergent active[1] | 6 | 12 | 3 | 6 |
| Sodium carbonate | 36 | 26 | 26 | 36 |
| Calcite[4] | 8 | 8 | 6 | 6 |
| Soap[5] | 12 | | | 8 |
| Coated NTA[3] | | 12 | 8 | |
| Sodium silicate | 12 | 12 | 8 | 8 |
| Sodium sulphate, water and other conventional ingredients | | balance to 100 | | |

Notes:
[1]As in Example 1
[2]As in Example 2
[3]As in Example 3
[4]Calofort U (16 $m^2/g$)
[5]As in Example 6

Example 8 represents a composition suitable for use at a low dosage level in relatively hard water, using a heat up cycle. Example 9 represents a composition suitable for use at low dosage in less hard water. The composition of Example 10 can be used at high dosage level in relatively soft water, and Example 11 at high dosage levels where the water is harder using a heat-up cycle.

As used herein all percentages are by weight based on the total weight of the composition unless otherwise stated.

We claim:

1. A detergent composition suitable for washing fabrics in water containing calcium hardness, the composition comprising:

(i) about 2.5% to about 30% of at least one synthetic detergent active material;

(ii) at least about 10% of an alkalimetal carbonate as a primary detergency builder material; and (iii) a secondary detergent builder material;

characterised by means for delaying the reaction between said secondary builder and the calcium hardness of the water until the critical state is reached, and secondary builder material being nitrilotriacetic acid coated with a fatty acid.

* * * * *